United States Patent [19]

Ura

[11] 3,973,106

[45] Aug. 3, 1976

[54] THIN FILM THERMAL PRINT HEAD

[75] Inventor: Frank Ura, Palo Alto, Calif.

[73] Assignee: Hewlett-Packard Company, Palo Alto, Calif.

[22] Filed: Aug. 14, 1975

[21] Appl. No.: 604,694

Related U.S. Application Data

[63] Continuation of Ser. No. 524,108, Nov. 15, 1974, abandoned.

[52] U.S. Cl. ..... 219/216; 219/543; 338/308

[51] Int. Cl.[2] ..... H05B 1/00

[58] Field of Search ..... 219/216, 543; 346/76 R; 338/306–309; 29/610, 611, 620; 357/56; 427/102, 103, 126

[56] References Cited

UNITED STATES PATENTS

| | | | |
|---|---|---|---|
| 3,495,070 | 2/1970 | Zissen | 219/216 |
| 3,598,956 | 8/1971 | Cady | 219/543 X |
| 3,609,294 | 9/1971 | Cady | 219/216 |
| 3,852,563 | 12/1974 | Bohorgner | 219/216 |

*Primary Examiner*—C. L. Albritton
*Attorney, Agent, or Firm*—F. David LaRiviere

[57] ABSTRACT

The thermal print head disclosed herein comprises resistive heating elements deposited on mesas of glass glaze over an aluminum oxide substrate for more efficient marking of thermally sensitive recording material. After the mesas are formed in the glass glaze by etching, resistive and conductive materials are deposited over the mesas by thin film techniques. Thereafter, the raised heater elements and conductors are delineated chemically, then heat-treated to upwardly adjust the resistance of and to grow a protective oxide over the individual heater elements. Since the resistance value of the heater elements can be controllably increased as a function of the temperature and time of heat treatment, external trimming resistors are eliminated. The protective oxide which forms over the resistors during heat treatment provides better adhesion to wear-resistant materials and an effective barrier to migration of ions from the recording material into the heater elements causing degration of performance and shortened element life.

8 Claims, 5 Drawing Figures

THIN FILM THERMAL PRINT HEAD

This is a continuation of application Ser. No. 524,108, filed Nov. 15, 1974, and now abandoned.

BACKGROUND & SUMMARY OF THE INVENTION

Thin film thermal print heads having resistive heating elements are known in the prior art as disclosed in U.S. Pat. No. 3,609,294, THERMAL PRINTING HEAD WITH THIN FILM PRINTING ELEMENTS, issued to Richard C. Cady, Jr. et al. on Sept. 28, 1971. In this printing head, planar resistive heater elements are covered by a protective layer of material having substantial thermal conductivity and electrical resistivity. The protective layer is shaped to provide a raised area over each of the heater elements. These raised mesa-like areas are merely thicker portions of the overcoating which protects the entire structure. The mesa-like areas provide concentrations of heat in close proximity to the thermally sensitive recording material. However, since the material is selected for high thermal conductivity, conduction of heat generated by the resistive heater elements to the surface of the recording material is dissipated by transmission of some of that heat into the thinner portions of the overcoating layer. Thus the thermal efficiency of this system is necessarily low. In the present invention, the resistive elements are formed over a mesa of glass glaze which places the source of heat itself in close proximity with the thermally sensitive recording material and reduces the heat dissipated throughout a protective overcoating layer. The thermal efficiency of the present invention is therefore much higher.

Ion migration barriers are also known in the prior art as disclosed in U.S. Pat. No. 3,598,956, ION MIGRATION BARRIER, issued to Richard C. Cady, Jr. et al. on Aug. 10, 1971. The ion migration barrier disclosed therein comprises an electrically conductive shield which isolates the resistive heater elements from ions which shortened heater element life. The migration barrier is insulated from the heater elements and from the thermally sensitive recording material by layers of glass, and is most effective when electrically biased or grounded. The ion barrier of the present invention is effective without electrical biasing or grounding, and does not require an insulating layer of glass between it and the heater elements. In addition the ion barrier of the present invention enhances adhesion of the wear layer to the heater elements.

The ion barrier described above is formed during a heat treatment process which also serves to adjust the value of the resistive elements. By controlling the temperature and time of heat treatment, the resistor values may be increased to a resistance value compatible with drive electronics. Since deposits of resistive material are more uniform in thin film technology than in other fabrication processes, external trimming resistors are generally not required. However, since heat treatment effects the resistance of all heater elements uniformly, it does allow the upward adjustment of that resistance to accommodate the electronic drive circuitry.

DESCRIPTION OF THE PREFERRED EMBODIMENT

Figure 1:
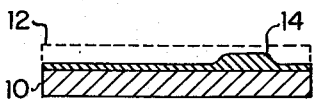
FIG. 1 is a cross-section of a substrate with glass glaze showing the mesa formed thereon for one heater element constructed according to the preferred embodiment of the present invention.

Referring to FIG. 1, substrate 10 is coated with a thick layer of high-temperature glass glaze 12. The glaze is then coated with a photoresist, baked, exposed and developed, leaving an etch-resistant pattern of photoresist material where the mesa is desired. The remaining unprotected glaze is then etched with hydroflouric acid to a thinner layer thickness than mesa 14. Substrate 10 can be 94–99% aluminum oxide or equivalent.

After the mesa has been formed for each resistive heater element as shown in FIG. 1, a coating of resistive material is deposited over the entire glass glaze area by thin film techniques such as evaporation or sputtering. Thereafter, by similar thin film techniques, a layer of conductive material is deposited over the same area. For the preferred embodiment of the present invention, the resistive material may be either tantalum nitride or tantalum/aluminum alloy or equivalent, and the conductor material may be either gold or aluminum or equivalent.

Figure 2:
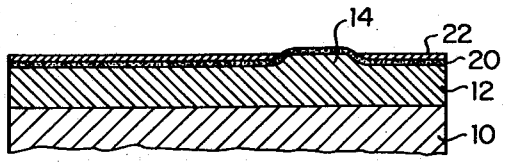
FIG. 2 is a cross-section of the substrate of FIG. 1 including the layers of resistive and conductive materials.

Referring now to FIG. 2, resistive material 20 is shown covering mesa 14. After applying, baking, exposing and developing photoresist to delineate the pattern of electrical conductors to the heater elements, conductor material 22 is then chemically etched to form individual conductors to each resistive heating element. Since resistive material 20 must be removed from the areas between conductors, that material is removed by a suitable chemical etching process or equivalent. Photoresist material is then again applied over the entire area, except where the resistive heating element is to be formed over mesa 14, thus delineating the resistive heating element. After baking, exposing and developing the photoresist, the conductor material is then chemically etched from the top of the resistor covering mesa 14.

Figure 3:
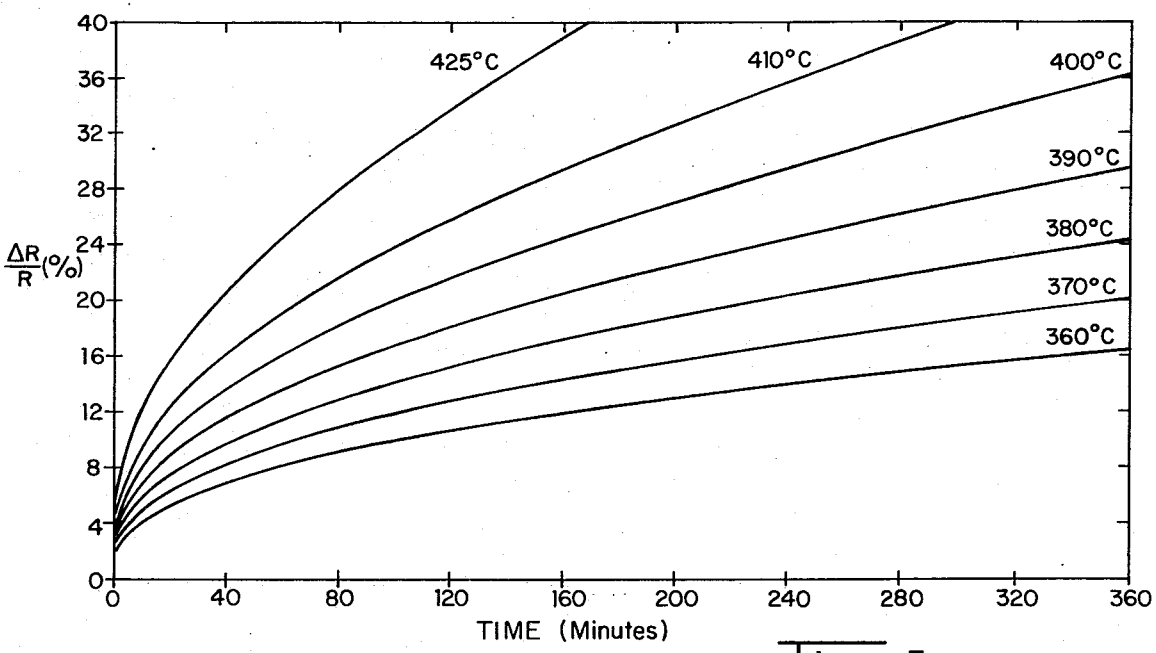
FIG. 3 shows the change of resistance versus time at various temperatures for tantalum nitride.

Prior to application of a wear-resistant material over the heater elements, the entire substrate is heat-treated. As shown in FIG. 3, by controlling the temperature and the time of heat treatment, the amount of resistance change in each resistive heating element can be controlled. While the resistance change is essentially uniform for all of the resistive heater elements on the substrate, this heat treatment provides a method by which the resistance value of the heater elements can be upwardly adjusted to accommodate particular electronic drive circuits.

During the heat treatment process, a protective oxide grows over each individual resistive heater element. This protective oxide serves as a barrier against migration of ions from commonly known sources such as the thermally sensitive recording material itself. Such ions migrating to and into the heater elements tends to contaminate those elements which reduces their reliability and shortens their life. In addition, this oxide provides a better adhesion of a wear layer applied to each heater element after heat treatment.

Figure 4:
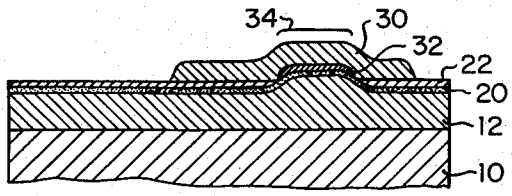
FIG. 4 is a cross-section of the substrate of FIG. 2 including the protective oxide and wear layer.

Referring now to FIG. 4, wear layer 30 is now applied over the immediate area of each heater element. The material is a wear-resistant, thermally-conductive material such as aluminum oxide. Thus a resistive heater element formed over mesas of glass glaze having a chemical ion migration barrier and protected by a wear layer has been constructed, which provides efficient developing of thermally sensitive recording material. The printing portion of the resistive heating element is shown in FIG. 3 at 34. Protective oxide 32 improves reliability in an ion-laden environment by a factor of approximately six to one. It can be shown that six times the number of heater element failures were encountered after printing more than 30,000 feet of paper without the protective oxide than with the protective oxide present.

Figure 5:
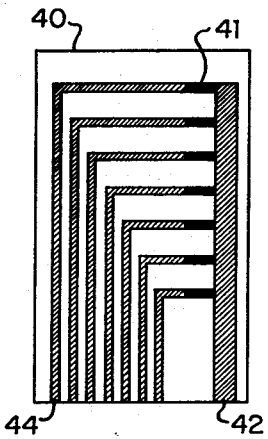
FIG. 5 is a top view of a thermal print head having a plurality of heater elements constructed according to the preferred embodiment of the present invention.

Referring now to FIG. 5, thin film thermal print head 40 comprises 7 resistive heater elements, for example 41, common conductor 42 and individual conductors, for example, 44. Each of the resistive heater elements and the conductors were formed as explained above for one of such elements. Print head 40 may be used for forming 5 × 7 matrix alphanumeric characters along one axis of thermally sensitive recording material such as is described in U.S. patent application Ser. No. 508,111 entitled METHOD AND APPARATUS FOR ENHANCING AND MAINTAINING CHARACTER QUALITY IN THERMAL PRINTERS filed by A. W. Kovalick on Sept. 23, 1974, and assigned to the assignee hereof.

I claim:

1. A thin film thermal print head for operation in an environment including a source of ions comprising:

an aluminum oxide substrate;

a layer of glass glaze covering the substrate having a plurality of mesas formed on the surface thereof;

a layer of resistive material covering the mesas to form resistive heater elements thereon;

a plurality of electrical conductors coupled to the heater elements for connecting electrical power thereto;

a layer of oxide of the resistive material covering each of the heater elements to insulate the heater elements from the ions; and a layer of wear-resistant material covering the layer of oxide and having relatively high thermal conductivity.

2. A thin film thermal print head as in claim 1 wherein the oxide layer also provides better adhesion of the wear-resistant material to the heater elements.

3. A thin film thermal print head as in claim 1 wherein the resistive material is selected from the group consisting of tantalum nitride and tantalum aluminum alloy.

4. A thin film thermal print head as in claim 1 wherein the wear-resistant material is aluminum oxide.

5. A thin film thermal print head as in claim 1 wherein the layer of oxide of the resistive material is formed by heating the heater elements.

6. A thin film thermal print head as in claim 5 wherein the resistance value of the heater elements is increased by said heating.

7. A thin film thermal print head as in claim 2 wherein the layer of oxide of the resistive material is effective as an ion insulator without electrically biasing said layer.

8. A thin film thermal print head as in claim 2 wherein the layer of oxide of the resistive material is effective as an ion insulator without electrically grounding said layer.

* * * * *